US005304263A

United States Patent [19]

Champin et al.

[11] Patent Number: 5,304,263

[45] Date of Patent: Apr. 19, 1994

[54] TITANIUM ALLOY PART

[75] Inventors: Bernard Champin, Saint Jorioz; Bernard Prandi, Seythenex, both of France

[73] Assignee: Compagnie Europeenne Du Zirconium Cezus, Courbevoie, France

[21] Appl. No.: 83,508

[22] Filed: Jun. 30, 1993

Related U.S. Application Data

[62] Division of Ser. No. 882,900, May 14, 1992, Pat. No. 5,264,055.

[51] Int. Cl.[5] ..... C22F 1/00

[52] U.S. Cl. ..... 148/671; 148/421; 148/670; 420/421

[58] Field of Search ..... 148/421, 670, 671; 420/421

[56] References Cited

U.S. PATENT DOCUMENTS 4,309,226 1/1982 Chen ..... 148/421

4,878,966 11/1989 Alheritiere et al. ..... 148/671

*Primary Examiner*—Upendra Roy

*Attorney, Agent, or Firm*—Dennison, Meserole, Pollack & Scheiner

[57] ABSTRACT

A titanium alloy part having a structure comprising ex-beta acicular grains and with equi-axial alpha phases gathered in a plurality of rows at boundaries of the grains. The alloy comprises, by weight, 2 to 5% Mo, 3.5 to 6.5% Al, 1.5 to 2.5% Sn, 1.5 to 4.8% Zr, Fe≦1.5%, 4 to 12% Mo+V+Cr, and the balance, titanium and impurities.

2 Claims, 3 Drawing Sheets

TITANIUM ALLOY PART

This is a divisional of copending application Ser. No. 07/882,900, filed May 14, 1992 now U.S. Pat. No. 5,264,055.

BACKGROUND OF THE INVENTION

The invention relates to a method of producing a part from cast and worked titanium alloy and intended for example for compressor discs for aircraft propulsion system, and also to the parts obtained;

In their patent EP-B-0287486=U.S. Pat. No. 4,854,977=U.S. Pat. No. 4,878,966, the Applicants described a method of producing a part from titanium alloy having the following composition (% by mass): Al 3.8 to 5.4—Sn 1.5 to 2.5—Zr 2.8 to 4.8—Mo 1.5 to 4.5—Cr less than or equal to 2.5 and Cr+V=1.5 to 4.5—Fe>2.0—Si>0.3—$O_2$<0.15 and Ti and impurities: the balance. According to this process, an ingot of the said alloy is hot worked this hot working comprising a roughing down under heat giving giving a hot blank, then final working of at least a part of this blank preceded by preheating to a temperature situated above the real beta transus of the said hot rolled alloy, the ratio of this final rolling "S:s" (initial cross-sectional:final cross-section) preferably being greater than or equal to 2, after which the part blank obtained by this final working is subjected to a solution heat treatment, and then an ageing treatment. The parts obtained have an ex-beta acicular structure with alpha phase at grain boundaries. The best set of mechanical characteristics obtained thus (sample "FB", tests according to the direction L) is: Rm=1297 MPa—$R_{p0.2}$=1206 MPa—A %=6.9—$K_{1c}$=51 MPa.$\sqrt{m}$. Creep at 400° C. under 600 MPa: 0.2% in 48.5 hr and 0.5% in 384 hr. in terms of service life, it has been found important to improve if possible the ductility (A %) without reducing the other mechanical characteristics.

The Applicants have sought to achieve this improvement and more generally to improve the compromise of mechanical properties obtained in such a titanium alloy component.

SUMMARY OF THE INVENTION

The object of the invention is a process which uses again the steps known from the aforementioned patent, but this process is applied to a titanium alloy having wider limits of composition, viz.:

Mo equivalent=5 to 13

Al equivalent=3 to 8

Ti and impurities: the balance,

"Mo equivalent" being equal to (Mo+V/1.5+Cr/0.6+Fe/0.35) and "Al equivalent" being equal to (Al+Sn/3+Zr/6+10×$O_2$ in accordance with the known definition of these two equivalents. And it applies with a final working ratio "S:s" of at least 1.5 and, often of less than 5. This method is characterised in that the hot rolled blank is cooled from its preheating temperature which is above the real beta transus down to a temperature for the beginning of final working and which is below this real beta transus and above the temperature at which the alpha phase appears under the conditions of said cooling of the said blank. The final rolling is then performed, thus extending beyond the appearance of the alpha phase at the grains boundaries and breaking at least once the alpha phase recrystallised between these beta grains.

Modified in this way, the process yields surprisingly improved mechanical properties and a microstructure of which the modifications are likewise surprising and seem to be linked to the ductility improvements observed.

DESCRIPTION OF THE PREFERRED EMBODIMENTS

The Applicants have found that when a part of titanium alloy of the type under consideration was cooled from the beta range, its beta grain structure became transformed to alpha below the real beta transus and in two successive phases: firstly, there is a nucleation and a growth of alpha phases at the boundaries of the beta grains, then, for example 60 to 100° C. lower according to the alloy, an acicular alpha transformation in these grains. The time-temperature said "CCT" graph relating to nucleation of the alpha phases at the grain joints as a function of the cooling rate or time of a sample can be determined by hardening dilatometry associated with micrographic observations. The definition of the real beta transus" and its experimental determination are moreover known from the aforementioned patent. The micrographic observations carried out during the course of the Applicants' tests lead to the following interpretation (schematic representation of FIG. 1): for a given ratio rate of final working; the final working of EP 387486 begins at (1) above the real beta transus (2) and ends at (3) or (4') in the alpha beta range (4) commencing by a metastable beta range (5), of which the conversion to alpha is delayed in relation to the equilibrium transus (2), and continuing with a range (6) of nucleation and growth of alpha phases boundaries of the beta grains. The ranges (5) and (6) are separated by a curve (7) indicating the fluctuation in the temperature of appearance of alpha phases as a function of the time. As already indicated, the acicular alpha transformation inside the beta grains commences far lower, according to a curve (13).

According to the preceding method, forging ends either at (3) in the metastable beta range (5) or at (3') in the range (6) of nucleation and growth of alpha phases at the grain boundaries.

According to the present invention, the starting point is an homogenised beta condition (8) and cooling is performed down to a beginning of forging (9) situated in the metastable beta range (5). Final working is then sufficient for it to end at (10) or (11) well within the alpha nucleation range (6). The consequences are as follows:

- a rolling of the beta structure is performed, breaking and refining the beta grains at a much lower temperature than previously,
- and above all the major part of the rolling then takes place in the range (6) where the alpha phase nuclei appearing firstly at the boundaries are broken, recrystallised and multiplied, forming multiple-row necklaces of alpha phases,
- furthermore, as it ends at (8,) beta preheating is preferably performed at a lower temperature than that (12) of the prior process. Being smaller, the initial beta grain produces a finer structure of the rolled metal and therefore a multiplication of the grain boundaries having multiple equi-axial alpha phases, which is favourable in terms of the mechanical strength and ductility characteristics of the end product.

Thus, a surprisingly modified structure is obtained, the alpha phases of the grain boundaries being positively present and multiplied, whereas in the prior process, at best, one only obtains boundaries which show the onset of alpha phase nucleation at the boundaries of beta grains.

Corresponding to this new structure, one obtains for example on the sample "NA" which can be compared with the previously mentioned "FB", the solution treatment and ageing treatments being respectively nearly the same for the two samples:

RM=1341 MPa-13 Rp0.2=1276 MPa—A %=10—Klc=72 MPa×$\sqrt{m}$—Creep at 400° C.: 0.2% in 120 hr.

Ductility is improved, together with the mechanical strength properties, tested in the longitudinal direction, and the creep resistance at 400° C.

The extension of the range of application of the method according to the invention takes the following facts into account:

when "Mo equivalent" is less than 5%, the stability of the beta phase is inadequate to allow a beginning of final working which is sufficient in metastable beta (5); when "Mo equivalent" is greater than 13%, the beta phase is too stable and there is not sufficient conversion of beta to alpha at the grain joints to obtain the mechanical properties desired (high mechanical strength with good elongation);

when Al equivalent is less than 3%, the mechanical characteristics are inadequate, and when Al equivalent is greater than 8 there is a substantial risk of precipitation of a fragilising intermetallic compound of the $Ti_3Al$ type.

Preheating is carried out prior to final rolling with a two-fold aim: to obtain good homogenisation in the beta phase while nevertheless limiting the enlargement of the beta grain growth. As a practical rule, since the blank produced under heat typically has a cross-section of around 220×220 sq.mm at this stage, it is preheated to at most 50° C. above the real beta transus, the temperature chosen being reached at the heart over at most 2 hours when this temperature does not exceed the said beta transus by more than 30° C. and over at most 1 hr when this temperature exceeds the said transus by more than that.

So that the beginning of working gives a good prior refinement of the beta grain, it is in practice desirable for the temperature of beginning of working (9) to be at least 10° C. above the temperature of appearance of the alpha phase, that is to say above the curve (7) in FIG. 1 Assuming that this temperature (7) is not clearly known, one can adopt as a practical rule the solution of setting the onset of working (7) at less than 50° C. below the real beta transus (2) and preferably 10 to 30° C. below this transus (2).

The situation of the onset of working (9) is advantageous because it makes it possible to obtain the structure according to the invention and the corresponding improved properties for various types of hot working with or without cooling during this working: the curve (7) can be traversed in the first half of the final rolling both in a forging between hot matrices, maintaining a substantially constant temperature and ending at (11), or in forging with natural cooling between passes, giving for instance a cooling rate of 5 to 10° C. per minute and ending at (10).

The extent of final working is often limited by the cooling, is increase above S:s=1.5 is desirable but in practice will not exceed a ratio S:s equal to 5.

For application of the process, the contents of certain elements are preferably limited as follows:

Mo less than or equal to 6%, to limit the drop in beta transus and in order thus to preserve a high temperature for the final working;

V less than or equal to 12% for a similar reason;

Cr less than or equal to 6% to limit hardening and segregations;

Fe less than or equal to 3 in order to avoid or limit precipitation of intermetallic compounds which reduce the resistance to creep above 500° C.;

Sn less than or equal to 3 in order to avoid precipitation;

Ar less than or equal to 5 to avoid fragilisation.

To be more precise, in order to obtain the most interesting mechanical properties, the following proportions are adopted:

(Mo+V+Cr)=4 to 12%=Mo=2 to 6%—Al=3.5 to 6.5%—Sn=1.5 to 2.5%—Zr=1.5 to 4.8%.

Likewise, one chooses Fe=0.7 to 1.5% in order to have an improved creep resistance at about 400° and generally $O_2$ is preferably limited to below 0.2% in the interests of tensile strength ($K_{1c}$) and Si to a maximum of 0.3% in the interests of ductility.

To complete the details given concerning the production process, the solution treatment after final hot working is carried out in (alpha+beta) and preferably between "true beta transus −20° C." and "true beta transus −100° C.", with a particular preference for "beta transus −5 to 6 times the Mo equivalent". The ageing treatment is typically performed at between 500 and 720° C. for 4 hours to 12 hours.

A second object of the invention is a part made from titanium alloy by the aforementioned method and combining the structure, the composition (% by mass) and the following characteristic features):

A) structure comprising ex-beta acicular grains and, at the boundaries of these grains, alpha phases gathered in multiple necklaces;

B) (Mo+V+Cr)=4 to 12—Mo=2 to 6—Al=3.5 to 6.5—Sn=1.5 to 2.5—Zr=1.5 to 4.8—Fe less than or equal to 1.5—Ti and impurities=the balance);

C) Rm longitudinally greater than or equal to 1300 MPa $R_{p0.2}$ longitudinally greater than or equal to 1230 MPa A % longitudinally greater than or equal to 8 $K_{1c}$ at 20° C. greater than or equal to 50 MPa. $\sqrt{m}$. Creep at 400° C. below 600 MPa:0.2% at more than 60 hrs.

The advantages of the invention are the following:

very good mechanical characteristics are regularly obtained;

all these characteristics, including the creep resistance under heat, show surprising levels;

economy of preheating, thanks to final working at a lower temperature.

EXAMPLES

Figure 2:
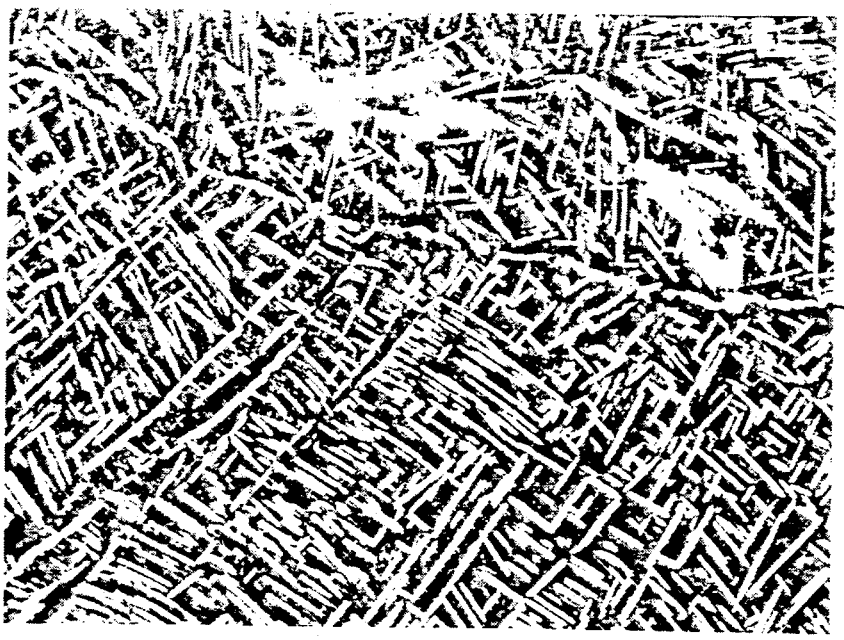
FIG. 2 shows a micrographic section through a sample of the prior art, in an 1100×enlargement.

1) FIG. 2, prior art

This is the sample "GB" described as "FB" in EP-B-0287486, the mechanical characteristics obtained according to the L direction were for "GB": Rm=1215 MPa, $R_{p0.2}$=1111 MPa—A %=8.4—$K_{1c}$=74 MPa.$\sqrt{m}$—creep at 400° C. under 600 MPa=0.2% in 25 hrs and 0.5% in 243 hrs. The composition was: Al 4.6—Sn 2.0—Zr 3.7—Mo 3.5—Cr 1.9—V 1.8—Fe<0.01—Si >0/01—$O_2$ 0.071—Ti and impurities=the balance.

Conditions of final rolling: real beta transus=870° C. final forging begun at 900° C. and finished under 870° C.—solution treatment at 840° C. followed by cooling in air, then ageing 8 hrs at 580° C.

FIG. 2 shows a continuous alpha phase at boundary 14 diagonally across the drawing, separating two ex-beta grains of alpha-acicular or needle-like structure.

Figure 3:
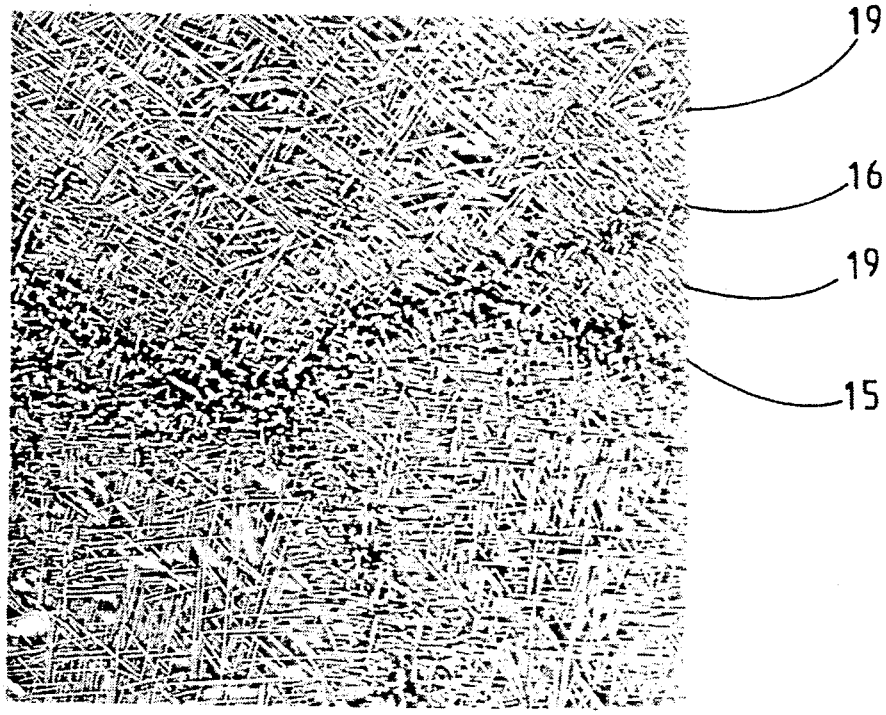
FIGS. 3 and 4 illustrate micrographic sections of 500× and 1100× of an "NC" sample according to the invention.
Figure 4:
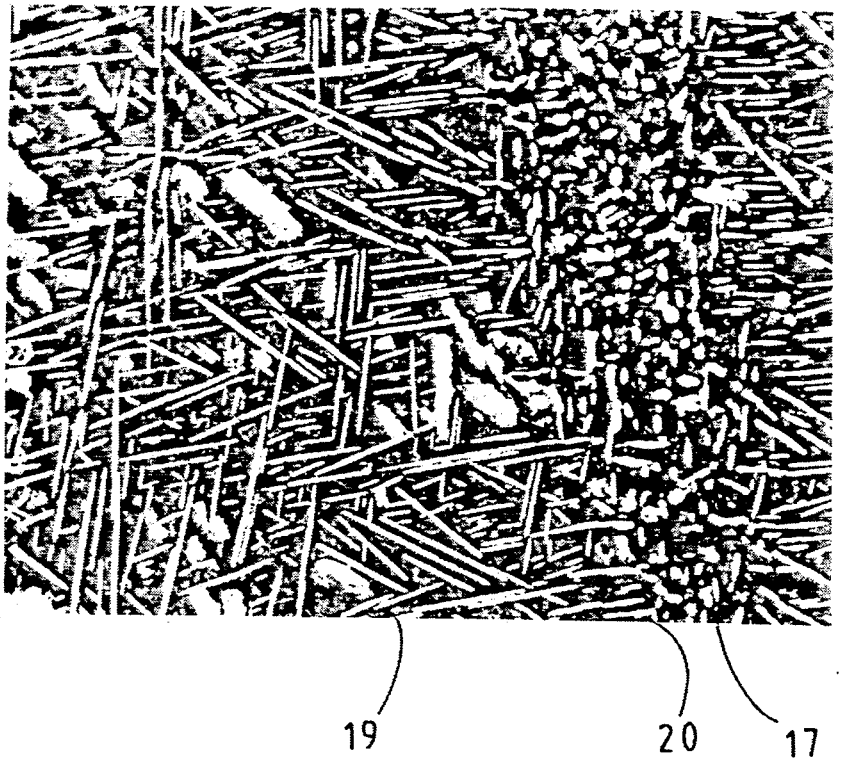

2) Tests according to the invention, FIGS. 3 and 4 Composition of the ingot "N":

Al 5.0—Sn 1.0—Zr 3.8—Mo 3.9—Cr 2.1—Fe 1.0 and Ti and impurities: the balance; in other words Mo equivalent=10.25 and Al equivalent=7.

Conversion: the 1.5 tonne ingot N was rough shaped by hot forging in the beta phase and then in the alpha+-beta phase (true beta transus=890° C.) to an octagonal hot-forged blank of 170 mm. Once delivered, the portions of hot forged blank were preheated to 920° C. (1 hr thoroughly), then cooled naturally to 800° C., then given a final working by forgoing to an octagon of 90 mm (S:s=3.6), the temperature then varying from 880° C. to 800° C. on the surface (840° C. at the heart).

The mechanically tested component blands (Table 2) were heat treated with various solution treatment ageing temperatures (Table 1). The solution processes were of 1 hr duration followed by cooling in the air, and the ageing processes were conducted for 8 hrs at the chosen temperature.

The creep test results correspond to two sets of tests shown respectively in columns (a) and (b) of Table 2. Compared with the samples "FB" and "GB" of the prior art process, listed for comparison in the present description, there is both a gain in Rm and in $R_{p0.2}$ and in A % and in creep, which it is appropriate to bring close to the new structure of the grain joints shown in FIGS. 3 and 4 which relate to the rough blank NC.

Instead of having a continuous alpha phase at boundary 14 (FIG. 2) with a mean thickness of 1 micrometer for "GB", according to the invention, one now has boundaries 15 or 16 or 17 of multiple row discontinuous equi-axial alpha phases 20 (FIGS. 3 and 4) having a total width ranging from approx. 5 to 20 micrometers, with a number of rows of equi-axial alpha phases 20 ranging from approx. 3 to 8 between the ex-beta acicular grains 19. These alpha phases are small and their individual dimensions range mostly from 1 to 5 micrometers×0.7 to 2 micrometers.

3. Test according to the invention, conducted on a different type of alloy

It concerns a less alloyed material:

Al 4.3—Mo 4.9—Cr 1.5—O=0.16—Ti and impurities: the balance.

Real beta transus=950° C.

For this alloy, Mo equivalent=7.5 and Al equivalent=4.4.

The ingot "P" was rough-shaped by hot forging in the beta phase, to produce a square blank of 150 mm. After being delivered, a first portion PA was preheated to 990° C. and forged from this temperature to a cross-section of 130×100 mm (S:s=1.7), this forging being executed in the beta phase. A second part was preheated to 970° C. and then cooled to 930° C., at which temperature final forging was commenced to obtain a cross-section of 130 mm×100 mm, this hot working being finished at 850° C. at the skin, in other words approx. 900° C. in the heart of the component blank.

The heat treatments which followed the final rolling were in each case: solution treating for 1 hr at 910° C., followed by cooling in the air and then ageing for 8 hrs at 710° C., likewise followed by cooling in the air.

Mechanical properties at 20° C. obtained (longitudinally):

| Reference | R (MPa) | Rp 0.2 (MPa) | A % | Klc MPa · $\sqrt{m}$ |
|---|---|---|---|---|
| PA outside the invention | 945 | 820 | 12 | 128 |
| PB according to the invention | 935 | 860 | 20 | 144 |

Figure 5:
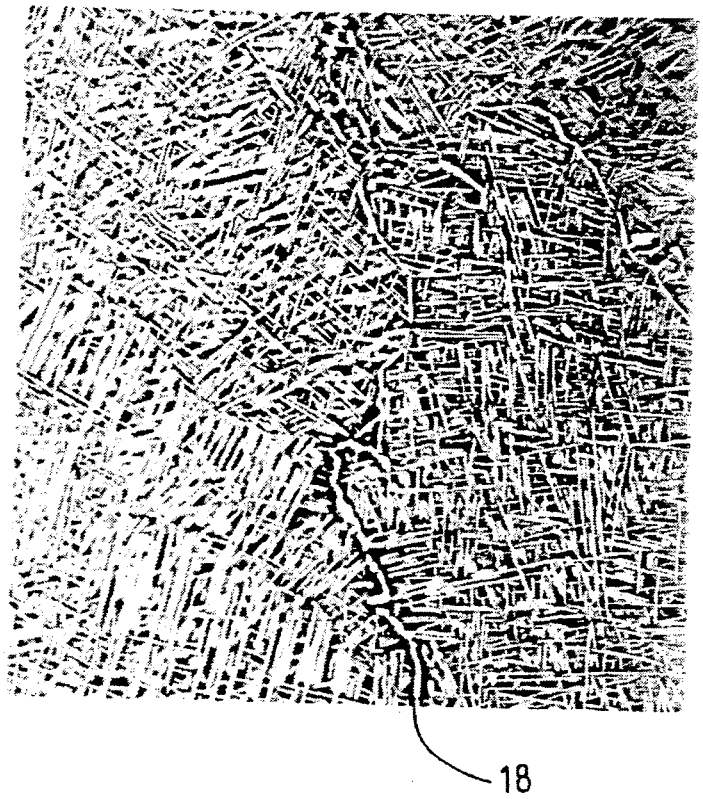
FIG. 5 shows a micrographic section at 500× of a sample of the same alloy forged outside the conditions of the invention.

4) Example of faulty final working, FIG. 5

A portion of a hot shaped blank NF from the same ingot N as before was finally forged under conditions different from those of the blanks NA to NE: the beginning of final working, here a substantially isothermal forging between hot dies, took place at 830° C., in other words 60° C. below the real beta transus equal to 890° C., and the working ratio S:s was 1.7.

Figure 1:
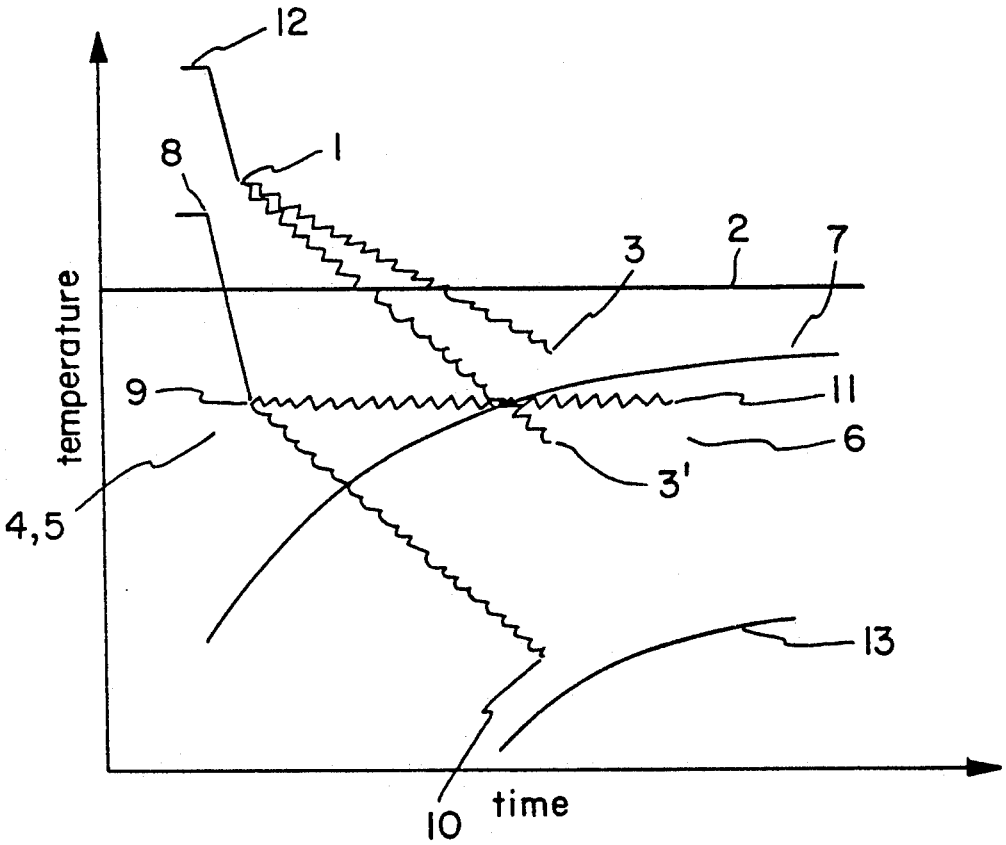
FIG. 1 already discussed shows the CCT phase diagram (time, temperature) of an alpha-beta titanium alloy, and shows the final working according to the prior art and in accordance with the invention.

After the same ageing and the same annealing as for NC to NE, micrographic examination was conducted (FIG. 5) showing thin alpha precipitation 18 at the boundaries between grains. It appears that the beginning of final working in a metastable beta range did not occur or was minimal, resulting in the absence of the structure shown in FIGS. 3 and 4. The position of the beginning 9 of final working in relation to the curve 7 (FIG. 1) of appearance of alpha phases at the grain boundaries is therefore fundamental.

TABLE 1

Temperatures (°C.) of the heat treatments of component blanks according to the invention

| Reference | Solution treatment | Ageing |
|---|---|---|
| NA | 860 (transus - 30° C.) | 580 |
| NB | 860 (transus - 30° C.) | 600 |
| NC | 830 (transus - 60° C.) | 580 |
| ND | 830 (transus - 60° C.) | 560 |
| NE | 830 (transus - 60° C.) | 540 |

TABLE 2

Results of mechanical tests (characteristics at 20° C. and creep resistance at 400° C.)

| Reference | RM (MPa) | Rp 0.2 (MPa) | A (%) | Klc (MPa · $\sqrt{m}$) | Creep at 400° C. under 600 Mpa 0.2% (hr) (a) | (b) |
|---|---|---|---|---|---|---|
| NA | 1341 | 1276 | 10 | 72 | 102 | 103 |
| NB | 1348 | 1289 | 8 | 73 | 84 | 210 |

TABLE 2-continued

Results of mechanical tests (characteristics at 20° C. and creep resistance at 400° C.)

| Reference | RM (MPa) | Rp 0.2 (MPa) | A (%) | Klc (MPa · $\sqrt{m}$) | Creep at 400° C. under 600 Mpa 0.2% (hr) (a) | (b) |
|---|---|---|---|---|---|---|
| NC | 1346 | 1287 | 10 | 73 | 81 | 148 |
| ND | 1345 | 1286 | 10.5 | 70 | 107 | 116 |
| NE | 1387 | 1295 | 10 | 61 | 134 | 220 |

What is claimed is:

1. A part formed of titanium alloy and comprising:

A) structure comprising ex-beta acicular grains and with equi-axial alpha phases gathered in a plurality of rows at boundaries of the grains;

B) a composition, in % by weight, comprising Mo=2 to 5, Al=3.5 to 6.5, Sn=1.5 to 2.5, Ar=1.5 to 4.8, Fe≦1.5, Mo+V+Cr=4 to 12, Ti and impurities=the balance; and C) mechanical properties such that Rm longitudinally≧1300 MPa, $R_{p0.2}$ longitudinally≧1230 MPa, A % longitudinally≧8, $K_{1c}$ at 20° C.≧50 MPa.√, and Creep at 400° C. below 600 MPa: 0.2% at more than 60 hrs.

2. A part acording to claim 1, in which said equi-axial alpha phases are disposed in 3 to 8 rows, most of said phases having individual dimensions of 1 to 5 micrometers×0.7 to 2 micrometers.

* * * * *